United States Patent [19]

Lien

[11] 4,037,654

[45] July 26, 1977

[54] PITLESS WELL ADAPTER APPARATUS

[75] Inventor: Neil C. Lien, Evansville, Wis.

[73] Assignee: Baker Manufacturing Company, Evansville, Wis.

[21] Appl. No.: 727,712

[22] Filed: Sept. 29, 1976

[51] Int. Cl.[2] ..... E21B 33/03; F16L 55/00

[52] U.S. Cl. ..... 166/88; 285/325

[58] Field of Search ..... 166/85, 88, 89; 285/325, 65

[56] References Cited

U.S. PATENT DOCUMENTS

| | | | |
|---|---|---|---|
| 656,956 | 8/1900 | Eibee | 285/325 |
| 823,346 | 6/1906 | Maxwell | 285/325 |
| 2,689,611 | 9/1954 | Martinson | 166/88 |
| 2,918,972 | 12/1959 | Tubbs | 166/85 |
| 3,812,910 | 5/1974 | Wellstein | 166/88 |
| 3,847,217 | 11/1974 | Kramer et al. | 166/85 |
| 3,869,000 | 3/1975 | English | 166/85 |
| 3,976,131 | 8/1976 | Woodford et al. | 166/85 |

*Primary Examiner*—James A. Leppink

*Attorney, Agent, or Firm*—Theodore J. Long; John M. Winter; Harry C. Engstrom

[57] ABSTRACT

A pitless well adapter apparatus providing an easily assembled coupling through a well casing between a well drop pipe and a water delivery pipe. The coupling members include an adapter body member connected to the drop pipe, and an adapter outlet member connected to the delivery pipe and firmly mounted to the well casing through an opening therein. A U-shaped skirt is formed around a side opening in the adapter body and has a beveled groove formed around the inner periphery thereof. A U-shaped beveled flange is formed on the intake end of the adapter outlet member and is shaped and sized to closely mate with the groove in the skirt on the adapter body. The adapter apparatus is assembled by lowering the adapter body, with the drop pipe connected thereto, until the grooved skirt of the adapter body member is fully engaged on the beveled flange of the adapter outlet member, at which point the interior bores of the adapter body and the adapter outlet member are in full communication to allow the flow of water therethrough. The engaged beveled flange and grooved skirt extend below the lower margins of the interior bores of the engaged members to substantially prevent relative parting movement of the two coupling members due to pressure moments.

7 Claims, 7 Drawing Figures

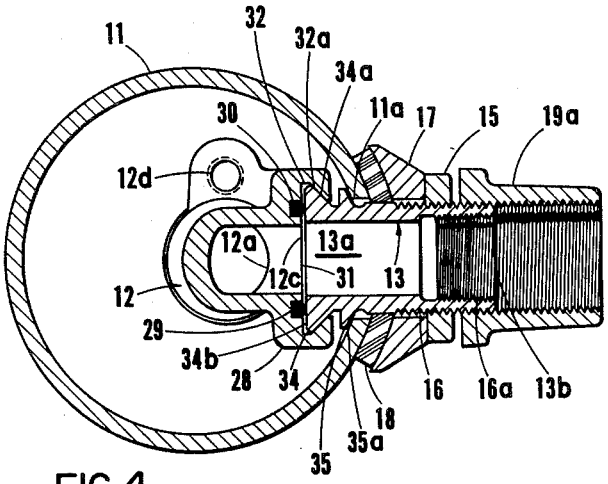
FIG. 4
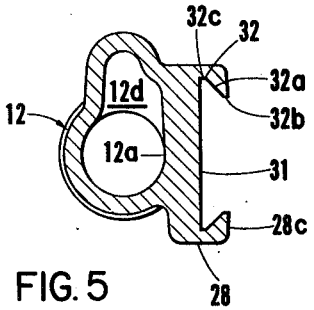
FIG. 5
FIG. 7
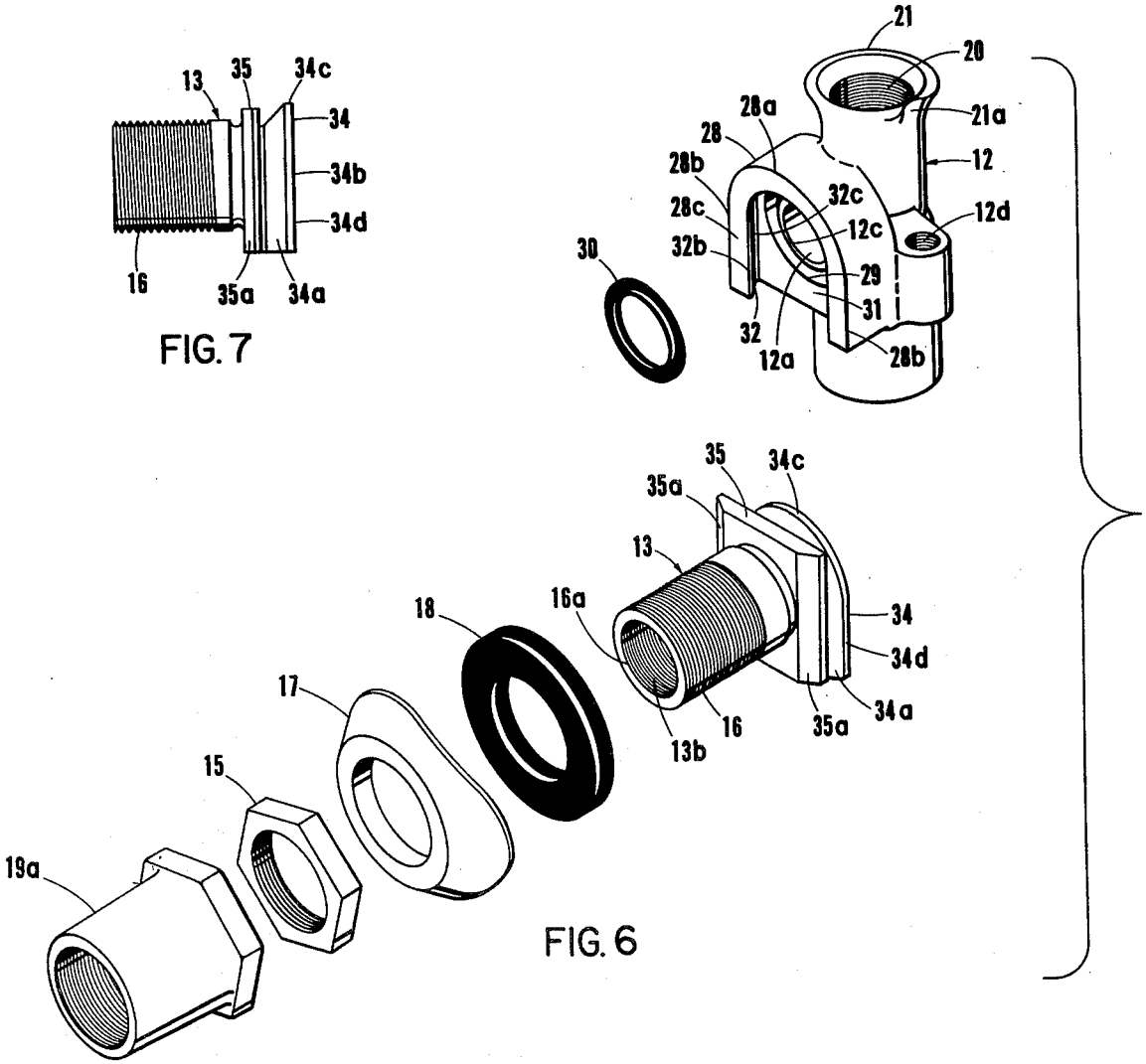
FIG. 6

PITLESS WELL ADAPTER APPARATUS

BACKGROUND OF THE INVENTION

1. Field of the Invention

This invention pertains generally to pitless well construction, and more particularly to pitless adapter apparatus for providing a sealed connection between a well drop pipe and a delivery pipe through an opening in the well casing.

2. Description of the Prior Art

In pitless well construction, the well drop pipe which supports the pump at the bottom thereof is connected through a coupling or adaptor to a generally horizontally disposed delivery pipe which delivers the well water to its point of use. The delivery pipe is generally rigidly connected and sealed to the well casing, and the drop pipe is coupled by various types of apparatus to the well casing to be in communication with the delivery pipe. Because of the limited working space within the well casing, various pitless coupling apparatus have been developed wherein a first coupling member is inserted into the opening in the well casing and is rigidly mounted thereto, with the delivery pipe being attached to this first coupling member. A second coupling member, which is attached to the well drop pipe to receive water therefrom, is then passed down into the well casing to slip onto the first coupling member until the two coupling members have their interior bores in communication such that water may be passed therethrough. Because the two coupling members in such coupling schemes are not threaded to each other, a possibility of leakage is presented at the joint between the two coupling members. The releaseable fitting between the two coupling members sometimes allows for play in the joint between the members when a pressure moment is applied to the joint. Such moments result from pressure heads within the pressurized well system, which are sometimes increased by the turning on and off of the pump at the end of the drop pipe, with consequent leakage of water under pressure around the joint and eventual accelerated deterioration of the seal at the joints.

Generally, it is desirable that the coupling member to which the drop pipe is attached be readily removable from the well casing to allow servicing of the coupling and of the drop pipe and pump. In addition, the adapter couplings must be capable of supporting the weight of the pump and drop pipe, and of supporting such weight structurally over a period of time while subject to vibrations and pressure moment stresses.

SUMMARY OF THE INVENTION

The pitless adapter apparatus of my invention provides an easily assembled coupling between the well drop pipe and the delivery pipe, while providing a firm and durable seal at the joint between an adapter body member thereof connected to the drop pipe and an adapter outlet member thereof connected to the delivery pipe. The adapter outlet member has a threaded portion which extends through a side opening in the well casing. The threaded portion is internally threaded for engagement with the delivery pipe and externally threaded to be engaged by a coupling nut which fixedly mounts the adapter outlet to the wall of the well casing. The coupling nut is preferably threaded onto the adapter outlet member with a curved washer and an elastomeric seal gasket provided between the coupling nut and the well casing to firmly seal the adapter outlet member ot the wall of the well casing.

An inverted U-shaped beveled flange is formed around the intake opening of the adapter outlet member, the flat part of the flange facing downwardly. The beveled flange of the adapter outlet member is slideably engaged by an inverted U-shaped skirt which extends around a side opening in the adapter body member. The flange and the skirt each have an arcuate portion extending above the adjacent opening and a pair of straight side portions which extend below the lower margins of the openings. The engaged beveled surfaces of the flange and the skirt resist and prevent any substantial relative parting of the engaged members due to pressure moments exerted on the members, but permit slideable engagement and disengagement of the members for installation and servicing purposes.

During assembly of the apparatus, the adapter body with the drop pipe and pump attached thereto is lowered into the well casing until the skirt on the adapter body engages the beveled flange on the adapter outlet, which is secured to the casing as previously described. Because the beveled flange and the skirt surrounding the side opening in the adapter body are in firm engagement, pressure moments exerted on the adapter body member and the adapter outlet member will be resisted by the engaged beveled surfaces of the flange and skirt without substantial parting or opening of the sealed joint between the adapter outlet member and the adapter body member. However, the beveled surfaces will readily permit sliding vertical disengagement of the adapter body member from the secured adapter outlet member for service.

A back-up plate is preferably formed on the adapter outlet member and is spaced away from the beveled flange thereon a distance sufficient to allow the U-shaped skirt of the adapter body member to fit closely on the beveled flange without interference by the back-up plate. The back-up plate abuts firmly against the inner wall of the well casing to absorb any pressure moments and transmit such moments to the well casing.

A groove is formed around the side opening of the adapter body member to allow an elastomeric sealing ring to be placed therein, wherein the sealing ring provides a water-tight seal at the joint between the adapter body and adapter outlet member.

A flared, threaded opening may be provided at the top of the adapter body to allow insertion and threaded engagement therein of a lift-out pipe, which may be maintained in the adapter body during use if desired to provide further structural support for the weight carried by the adapter body. An accessory port may also be formed in the adapter body member in communication with the interior bore of the adapter body to allow a pressure sensitive switch connected thereto to control pump operation. The top of the adapter body member, to which the lift-out pipe is threadingly engaged, may be flared to facilitate insertion of the lift out pipe therein.

Further objects, features, and advantages of my invention will be apparent from the following detailed description taken in conjunction with the accompanying drawings showing a preferred embodiment of pitless adaptor apparatus exemplifying the principles of my invention.

BRIEF DESCRIPTION OF THE DRAWINGS

In the drawings:

FIG. 4 is a cross-sectional view of my pitless adapter apparatus taken along the line 4—4 of FIG. 2.

FIG. 5 is a cross-sectional view of the adapter body member only of my pitless adapter taken along the line 5—5 of FIG. 2.

FIG. 6 is an exploded perspective view of my pitless adapter apparatus showing the parts thereof in position for assembly.

FIG. 7 is a side view of the adapter outlet member of my pitless adapter apparatus.

DESCRIPTION OF A PREFERRED EMBODIMENT

Figure 1:
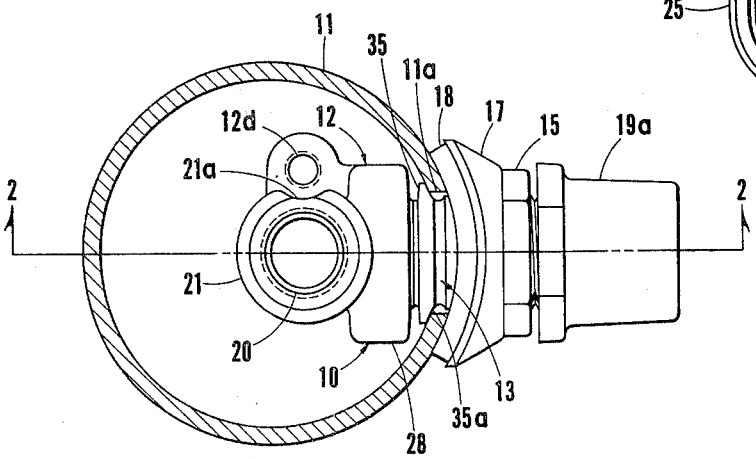
FIG. 1 is a top view of my pitless adapter apparatus shown emplaced in a well casing, with the well casing shown in cross section.

Referring now more particularly to the drawings, wherein like numerals refer to like parts throughout the several views, a preferred embodiment of my pitless adapter apparatus is shown generally in a top view at 10 in FIG. 1, emplaced in a cylindrical well casing 11. The adapter apparatus 10 includes an adapter body member 12 and an adapter outlet member 13. As best shown in the cross-sectional view of FIG. 2, the adapter body member 12 has a central interior bore **12*a* and a bottom opening 12*b* with internal pipe threads to which the well drop pipe 14 may be threadedly attached. When the adapter body member 12 is in position within the well casing 11, the central bore 12*a* of the body 12 is in communication with the interior bore 13*a* of the adapter outlet member 13**.

The adapter outlet member 13 is secured to the well casing 11 by an internally threaded nut 15 which engages external threads on the discharge end 16 of the adapter outlet member. The engageable internal threads of the nut 15 and external threads of the adapter outlet member discharge end 16 are straight (not tapered) threads which permit the nut 15 to act as a structural nut as described below. The nut 15 firmly secures the adapter outlet member 13 within the opening **11*a* in the well casing, and preferably engages a curved washer 17, which itself is pressed against an annular seal gasket 18** composed of an elastomeric sealing material such as neoprene or Buna N rubber.

A back-up plate 35 with beveled outer vertical edges **35*a* is formed on the adapter outlet member 13 intermediate its ends. The back-up plate beveled outer vertical edges 35*a* are designed to engage the inner surface of the well casing 11 when the adapter outlet member is mounted in position thereon, as best shown in FIGS. 1 and 4. The contact between the interior wall of the well casing 11 and the backup plate beveled sides 35*a* is maintained by the coupling means comprising the nut 15, curved washer 17 and seal gasket 18, which firmly holds the adapter outlet member 13 in its position within the opening 11*a* in the well casing, and allows the adapter outlet member to resist any pressure moments transmitted thereto by the adapter body member 12**.

The water delivery pipe 19 (shown spaced away from the adapter outlet member in FIG. 2) is engageable with the adapter outlet member discharge opening **13*b* in communication with the interior bore 13*a*. As shown, a standard taper threaded coupling 19*a* is engaged on the straight external threads of the adapter outlet member discharge end 16 to provide a water-tight connection therebetween. The pipe threads of the water delivery pipe 19 are then engageable in the coupling free end to provide the required communication between the adapter outlet member interior bore 13*a* and the delivery pipe 19. Internal pipe threads 16*a* are preferably provided at the discharge opening 13*b*** of the adapter outlet member, with which the threaded end of a smaller water sized delivery pipe may be threadedly engaged, if desired.

To facilitate insertion and removal within the well casing 11 of the adapter body member 12, along with the attached water drop pipe 14 and a pump (not shown) supported at the end of the drop pipe, the top of the adapter body has an upwardly opening threaded bore 20 formed therein into which a lift-out pipe (not shown) may be threadedly engaged. The lift-out pipe may be maintained within the threaded bore 20 and be attached at its top end to the well casing 11 at the well cap (not shown) to aid in the vertical support of the adapter body 12 and the weight carried thereby. The lift-out pipe may also be completely removed when the adapter body is in its operative position supported by the adapter outlet member. To facilitate insertion of the lift-out pipe into the threaded bore 20 within the well casing at some distance from the top end access position, the top of the adapter body member 12 has an outwardly flared portion 21 which guides the threaded end of the lift-out pipe into engagement with the threaded bore 20. A drain port **20*a* is provided at the bottom of the threaded bore 20** to prevent accumulation of water and dirt therein.

Figure 3:
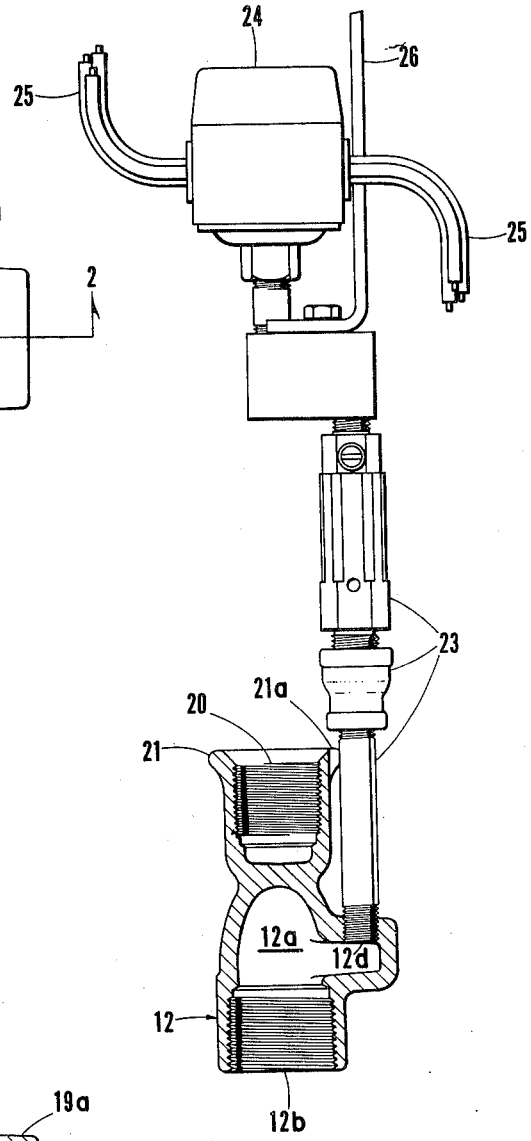
FIG. 3 is a cross-sectional view of my pitless adapter apparatus taken along the line 3—3 of FIG. 2, shown in conjunction with a pressure switch and associated accessory piping illustrated in full section.

As best shown in the cross-sectional view of FIG. 3, the adapter body member 12 may be provided with an auxilliary port **12*d*, which is in communication with the central interior bore 12*a* of the adapter body and which defines an upwardly extending threaded opening. Auxilliary connecting piping 23 may be threadedly engaged to the auxiliary port 12*d* to transmit the water pressure within the central bore 12*a* to an optional pressure sensitive switch 24. A dimple or depression 21*a* is formed in the outer edge of the flared portion 21 to allow the piping 23 to clear the flared portion. The switch 24 is connected in the power lines 25 which lead to the electric motor which drives the pump at the bottom of the well. The pressure sensitive switch 24 responds to water line pressures to control operation of the pump and the system. As shown in FIG. 3, a bracket 26 may be attached to the auxilliary piping 23, with the bracket 26 being itself attached at the top thereof to the well cap or to a mounting bracket near the top of the well (not shown) to provide additional vertical support to the pressure switch and auxilliary piping 23, as well as providing some support to the adapter body member 12**.

The details of the construction of my pitless adapter apparatus are best described with reference to the exploded view of FIG. 6. The side opening **12*c* of the adapter body member 12 is in communication with the central interior bore 12*a* of the adapter body. Water pumped up through the drop pipe 14 will pass through the interior bore 12*a* of the adapter body and out the side opening 12*c*. A side face 31 extends around the side opening 12*c* of the adapter body and is substantially flat, with an annular sealing channel 29 formed in the side face 31 and adapter body 12 around the opening 12*c*. A sealing O-ring member 30, formed of an elastomeric material, fits into the sealing channel 29 to provide a preferred sealing means between the adapter body 12 and the adapter outlet 13**, as will hereinafter be more fully described.

An inverted U-shaped skirt 28 is formed around the side opening 12*c* as an integral part of the adapter body member 12. The downwardly opening U-shaped skirt extends outwardly from the side face 31 in spaced relation to the opening 12*c* and the sealing channel 29 of the adapter body. As shown in FIG. 6, the skirt 28 has an arcuate upper portion 28*a* extending above the side opening 12, a pair of straight sides 28*b* extending downwardly from the arcuate upper portion to a point below the lower margin of the side opening, and a substantially flat exterior face 28*c*. An inwardly beveled groove 32 is formed completely around the inner periphery of the skirt 28, the beveled surface 32*a* of the groove extending obliquely between the inner front edge 32*b* and the inner rear edge 32*c* of the groove 32, as best illustrated in FIG. 5.

The adapter outlet member 13 has a sealing face 34*b* which extends around the intake opening 13*c*, and a flange 34 which is formed on the intake end thereof as an extension of the sealing face 34*b*. The sealing face 34*b* is substantially flat to mate flush against the side face 31 of the adapter body and compress the sealing O-ring member 30 within the sealing channel 29 to provide a water-tight joint between the two adapter members 12 and 13.

Figure 2:
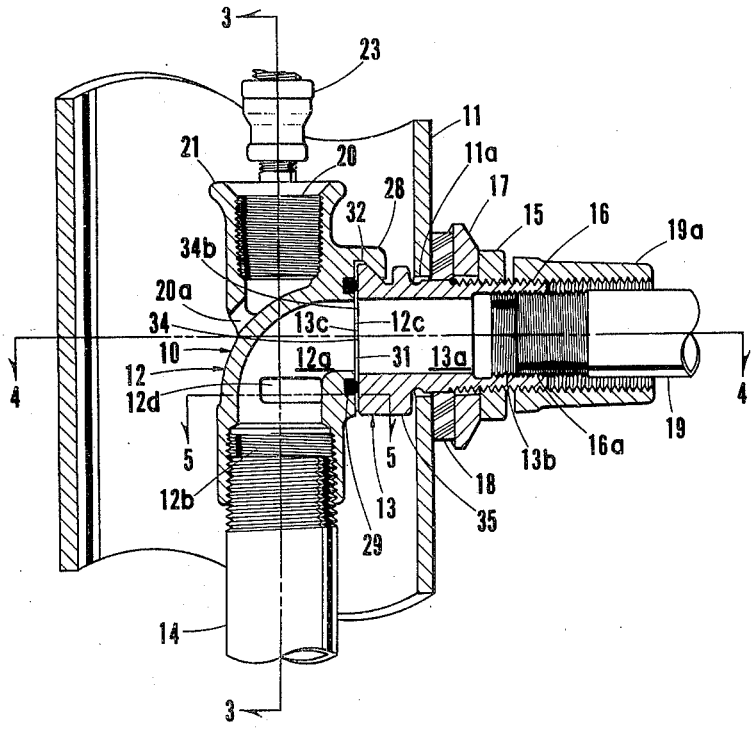
FIG. 2 is a cross-sectional view of the pitless adapter apparatus of FIG. 1 taken along the line 2—2 of FIG. 1

The flange 34, like the U-shaped skirt 28, is also formed in an inverted U-shape, and its peripheral surface 34*a* is outwardly beveled at an angle corresponding to the inwardly beveled groove 32 of the skirt 28. The U-shaped flange 34, which is adapted to be inserted into the beveled groove 32 of the skirt 28, also has an arcuate upper portion 34*c* extending above the intake opening 13*c* and a pair of straight sides 34*d* extending downwardly to a point below the lower margin of the intake opening 13*c*. When the beveled flange 34 is fully engaged within the beveled groove 32 of the skirt 28, the arcuate upper portion 34*c* of the flange 34 will abut against the arcuate upper portion 28*a* of the skirt 28 to support the adapter body member 12 within the well casing 11. The corresponding engagement of the straight sides 28*b* of the skirt 28 by the straight sides 34*d* of the U-shaped flange 34 will prevent any substantial parting or separating movement of the adapter body member 12 from the adapter outlet member 13 due to pressure moments exerted against the members by the water, which if not so prevented would tend to open the joint between the sealing face 34*b* of the flange 34 and the side face 31 of the adapter body. The full insertion of the flange 34 into the groove 32 is best shown in FIGS. 2 and 4, in which the central interior bore 12*a* of the adapter body and the interior bore 13*a* of the adapter outlet member are shown in full communication.

It is preferred that the angle which the beveled surface 34*a* of the flange 34 makes with the sealing face 34*b* of the flange be approximately 45°, and that the beveled surface 32*a* of the inwardly beveled groove 32 in the interior of the skirt 28 have a similar angle with respect to the side face 31 of the adapter body. It is desired that the beveled surfaces will smoothly and slideably engage to provide a rigid joint, but will permit vertical slideable disengagement of the two members, without substantial sticking, for service. The coefficient of friction of the metal surfaces forming the flange surface 34*a* and the beveled surface 32*a* of the groove 32 should desirably be no greater than one. Thus, a common bevel angle of approximately 45° will provide optimum sliding and non-sticking conditions over the greatest coefficient of friction range, as illustrated in Lien U.S. Pat. No. 3,650,893.

The assembly of my pitless adapter apparatus may best be understood with primary reference to the exploded view of FIG. 6. The discharge end 16 of the adapter outlet member 13 is first inserted through a circular opening 11*a* in the well casing. The annular gasket 18 and the curved washer 17 are then fitted over the discharge end 16 on the outside of the well casing, and the nut 15 is threadedly engaged thereon to force the washer 17 and gasket 18 respectively toward and against the outside of the well casing. Mounting of the adapter outlet member 13 on the well casing 11 is then completed by tightening the nut 15 to securely engage the well casing 11 between the adapter outlet back-up plate 35 and the coupling means. The threaded coupling 19*a* may then be threadedly engaged on the external threads of the discharge end 16; or alternatively, the delivery pipe 19 may be engaged within the internal pipe threads 16*a* of the discharge opening 13*b* either before or after the nut 15 has been firmly tightened against the washer 17.

The adapter body member 12, with the well drop pipe threaded into the bottom opening 12*b* thereof, may then be lowered by means of a lift-out pipe engaged within the threaded bore 20, until the skirt 28 is engaged over the U-shaped flange 34. As the flange 34 is engaged within the beveled groove 32 of the skirt 28, the O-ring seal 30 is compressed into the sealing channel 29 by the outlet member sealing face 34*b* to provide a substantially water-tight seal between the adapter body member 12 and the adapter outlet member 13 which surrounds the communicating openings 12*c* and 13*c*. At this point, the lift out pipe may optionally be removed and the connecting pipes 23 of the pressure sensitive switch 24 may be engaged within the accessory port 12*d*.

It is understood that my invention is not confined to the particular construction and arrangement of parts herein illustrated and described, but embraces all such modified forms thereof as may come within the scope of the following claims.

I claim:

1. A pitless adapter apparatus for connecting a well drop pipe to a delivery pipe through an opening in a well casing, comprising:

a. an adapter outlet member having an interior bore extending therethrough with an intake opening and a discharge opening for communication with a delivery pipe, a sealing face extending around the intake opening, an inverted U-shaped flange extending partially around the sealing face and having an arcuate upper portion and a pair of straight sides extending downwardly to a point below the lower margin of the intake opening, the peripheral surface of the flange being outwardly beveled at an angle of approximately 45° to the sealing face;

b. an adapter body member having a central bore extending therethrough with a bottom opening for communication with a well drop pipe and a side opening, a side face extending around the side opening, and an inverted U-shaped skirt extending outwardly from the adapter body member and having an arcuate upper portion extending above the side opening and a pair of straight sides extending downwardly from the upper arcuate portion on either side of the side opening to a point below the lower margin of the side opening, the skirt having a groove being inwardly beveled at an angle of approximately 45° to the side face and extending about the inner periphery of the skirt, the skirt being slideably engageable on the adapter outlet member flange whereby the body side opening and outlet member intake opening are substantially in registry and engagement of the beveled surfaces of the straight sides of the flange and skirt in mating relation prevents significant parting movement between the engaged members when the adapter apparatus is subjected to operating pressure moments, the engageable beveled surfaces of the flange and the skirt having a relative coefficient of friction no greater than one, the top of the adapter body member having an upwardly opening threaded bore with an outwardly flared portion around the threaded bore to locate and engage a threaded lift-out pipe within the threaded bore to facilitate engagement and removal of the adapter body member on the adapter outlet member within the well casing, the adapter body member further having an auxiliary opening in communication with the central interior bore and which opens upwardly to allow engagement of a connecting pipe for a pressure switch; and c. sealing means engageable between the adapter outlet member sealing face and the adapter body member side face for providing a water-tight seal therebetween.

2. The pitless apparatus of claim 1 wherein the adapter body member side face has an arcuate sealing channel extending around the side opening, and the sealing means comprises an O-ring seal engageable within the adapter body sealing channel and against the adapter outlet member sealing face in compressed relation when the skirt and flange of the members are slideably engaged with the side opening and intake opening substantially in registry.

3. The pitless adapter apparatus of claim 1 including a threaded lift-out pipe engaged within the threaded bore to facilitate engagement and removal of the adapter body member on the adapter outlet member within the well casing.

4. The pitless adapter apparatus of claim 1 wherein a back-up plate extends outwardly from the adapter outlet member in spaced relation to the flange to permit full engagement of the adapter body skirt on the flange, and a nut is threadedly engaged on the outlet member whereby the back-up plate may be drawn into engagement with a well casing to secure the adapter outlet thereto.

5. The pitless adapter apparatus of claim 4 wherein the vertical edges of the back-up plate are beveled to provide firm engagement of the back-up plate beveled surfaces with cylindrical well casings of a plurality of sizes.

6. The pitless adapter apparatus of claim 1 including coupling means for fixedly securing the adapter outlet member on a cylindrical well casing through an opening therein in supporting relation.

7. The pitless adapter apparatus of claim 6 wherein the coupling means includes a resilient annular sealing gasket adapted to fit closely over the adapter outlet member, a washer adapted to fit over the outlet member and having a curved washer surface adapted to force the sealing gasket into full engagement against the cylindrical well casing, and a nut adapted to threadedly engage the adapter outlet member whereby the washer and sealing gasket may respectively be forced toward and against the well casing.

* * * * *